US010192384B2

(12) United States Patent
Blythin et al.

(10) Patent No.: US 10,192,384 B2
(45) Date of Patent: Jan. 29, 2019

(54) MONEY ITEM HANDLING DEVICE AND CONVEYOR

(71) Applicant: Crane Payment Innovations Limited, Lancashire (GB)

(72) Inventors: Robert James Blythin, Manchester (GB); Andrew Barson, Cheshire (GB); David Taylor, Bolton (GB)

(73) Assignee: Crane Payment Innovations Limited, Lancashire (GB)

( * ) Notice: Subject to any disclaimer, the term of this patent is extended or adjusted under 35 U.S.C. 154(b) by 0 days.

(21) Appl. No.: 15/326,645

(22) PCT Filed: Jun. 29, 2015

(86) PCT No.: PCT/GB2015/051886
§ 371 (c)(1),
(2) Date: Jan. 16, 2017

(87) PCT Pub. No.: WO2016/009172
PCT Pub. Date: Jan. 21, 2016

(65) Prior Publication Data

US 2017/0206729 A1 Jul. 20, 2017

(30) Foreign Application Priority Data

Jul. 16, 2014 (GB) ..... 1412633.8

(51) Int. Cl.
*G07D 3/00* (2006.01)
*G07D 9/00* (2006.01)
*G07D 9/04* (2006.01)

(52) U.S. Cl.
CPC ..... *G07D 9/008* (2013.01); *G07D 9/04* (2013.01)

(58) Field of Classification Search
CPC . G07D 3/00; G07D 9/00; G07D 9/008; G07F 3/00; G07F 3/04
(Continued)

(56) References Cited

U.S. PATENT DOCUMENTS 3,463,171 A * 8/1969 Dolman ..... G07D 9/008 198/431
4,535,794 A * 8/1985 Bellis ..... G07D 9/008 221/253
(Continued)

FOREIGN PATENT DOCUMENTS

CN 101796552 A 8/2010
EP 2801957 A1 11/2014
(Continued)

OTHER PUBLICATIONS

Transmittal of the International Search Report and the Written Opinion of the International Searching Authority dated Sep. 15, 2015, 10 pages.
(Continued)

*Primary Examiner* — Jeffrey A Shapiro

(57) ABSTRACT

A handling device for money items such as coins and tokens has a receiving station (6) at which coins are fed onto a conveyor (4) that feeds them one by one to a processing station (9). The conveyor is made up of conveyor link members (17, 18) having a money item receiving surface (21), and first and second lugs (30, 31) upstanding from the surface (21), each having forward facing capture regions (33, 35) configured to be driven in a longitudinal conveying direction C through the receiving station (6) to receive a coin or token its major discoidal surface overlying the surface (21) and with its peripheral edge abutting the capture regions (33,35) of the lugs (30,31), one of the capture regions of the lugs being upstanding from the surface (21) at least in part by a height (h2) greater than the other capture region (h3),
(Continued)

so as to capture and singulate the coins in a manner that prevents two coins from being held, such that one of them is ejected.

16 Claims, 8 Drawing Sheets

(58) Field of Classification Search
USPC ..... 453/7, 11, 56
See application file for complete search history.

(56) References Cited

U.S. PATENT DOCUMENTS

| | | | | |
|---|---|---|---|---|
| 6,328,646 | B1 * | 12/2001 | Abe | G07D 9/008 198/550.01 |
| 6,579,166 | B2 * | 6/2003 | Abe | G07D 9/008 453/56 |
| 6,761,627 | B2 * | 7/2004 | Abe | G07D 9/008 453/56 |
| 8,840,450 | B2 * | 9/2014 | Watson | G07D 3/14 453/56 |
| 9,183,687 | B2 * | 11/2015 | Martin | G07D 3/00 |
| 2003/0032387 | A1 * | 2/2003 | Abe | G07D 9/008 453/56 |
| 2005/0277378 | A1 * | 12/2005 | Schimpl | G07D 9/008 453/18 |
| 2009/0008215 | A1 * | 1/2009 | Bell | G07D 3/14 194/342 |
| 2010/0203817 | A1 * | 8/2010 | Rigo | G07D 3/14 453/3 |
| 2010/0210200 | A1 * | 8/2010 | Bell | G07D 1/00 453/3 |
| 2010/0227539 | A1 * | 9/2010 | Aguado Vitas | G07D 1/00 453/56 |
| 2011/0105002 | A1 * | 5/2011 | Blaha | G07D 3/14 453/58 |
| 2012/0122385 | A1 * | 5/2012 | Watson | G07D 3/14 453/56 |
| 2012/0261434 | A1 * | 10/2012 | Bell | G07D 3/14 221/1 |
| 2014/0194045 | A1 * | 7/2014 | Fischer | G07D 3/14 453/3 |

FOREIGN PATENT DOCUMENTS

| | | | |
|---|---|---|---|
| GB | 2485395 | A | 5/2012 |
| GB | 2513539 | A | 11/2014 |
| WO | 2009030651 | A2 | 3/2009 |

OTHER PUBLICATIONS

Search Report dated Jan. 20, 2015 in connection with British Application No. 1412633.8, 2 pages.

Search Report dated Jan. 20, 2015 in connection with British Application No. 1412633.8, 4 pages.

Communication from a foreign patent office in a counterpart foreign application, State Intellectual Property Office of the Peoples Republic of China, "Notification of the First Office Action (PCT Application Entry into the National Phase)," Application No. CN201580036221.7, dated Aug. 27, 2018, 23 pages.

* cited by examiner

MONEY ITEM HANDLING DEVICE AND CONVEYOR

CROSS-REFERENCE TO RELATED APPLICATION(S)

The present application claims priority under 35 U.S.C. § 365 to International Patent Application No. PCT/GB2015/051886 filed Jun. 29, 2015, entitled "MONEY ITEM HANDLING DEVICE AND CONVEYOR", and through International Patent Application No. PCT/GB2015/051886, to British Patent Application No. 1412633.8, filed Jul. 16, 2014, each of which are incorporated herein by reference into the present disclosure as if fully set forth herein.

FIELD

This specification relates to a money item handling device and particularly to a conveyor to receive and convey money items having a generally discoidal surface, such as coins and tokens.

BACKGROUND

Money item handling devices are commercially available that employ a conveyor to transport coins and like money items to a processing station, for example for validation and temporary storage prior to being paid out to a user, for example as change in a vending machine transaction.

SUMMARY

One embodiment of a handling device, comprises a receiving station for receiving money items having a generally discoidal surface and a peripheral edge supplied thereto, a money item processing station, and a conveyor configured to convey money items from the money item receiving station to the processing station, the conveyor comprising a conveyor member having a money item receiving surface, and first and second lugs upstanding from said surface each having forward facing capture regions configured to be driven in a longitudinal conveying direction through the money item receiving station to receive a money item with its major discoidal surface overlying the surface and with its peripheral edge abutting the capture regions of the lugs, one of the capture regions of the lugs being upstanding from said money item receiving surface at least in part by a height greater than the other capture region. The capture regions may be so arranged that if first and second of said money items become lodged on the money item receiving surface and abutting the first and second capture regions respectively, upon forward movement of the conveyor in the longitudinal conveying direction, the first money item is urged by the first capture region against the second money item so as to dislodge the second money item from abutment with the second capture region so that solely the first money item is held in abutment with the first and second capture regions.

The receiving station may be configured to receive a plurality of money items of different dimensions that comprise opposed, spaced apart, generally discoidal major surfaces with a thickness dimension between the major surfaces falling within a predetermined thickness range having a minimum thickness value, wherein the maximum height by which the capture regions of first and second lugs are each upstanding from the money item receiving surface is more than said minimum thickness value and less than said minimum thickness value respectively.

The lugs may be disposed on opposite sides of a longitudinal axis of the conveyor member, and the capture region of the first lug may comprise a capture surface facing forwardly in the longitudinal conveying direction, having a height which reduces in the direction of said longitudinal axis, and may be trapezoidal, forming an acute angle with the longitudinal axis in the conveying direction and with a height that increases outwardly from the longitudinal axis.

The second capture region may comprise an upstanding capture edge at the join of first and second guide surfaces that are upstanding from the money item receiving surface and diverge rearwardly with respect to said longitudinal conveying direction.

At least one scoop surface on the or each of the first and second lugs may be provided, so that if first and second of the money items become arranged in a stack in engagement with the capture region of the first lug, an upper one of the money items is guided by the or each said scoop surface to pass by the lugs upon forward movement of the conveyor in said longitudinal conveying direction such that solely the lowermost money item in the stack abuts the first and second capture regions. The scoop surfaces may diverge from the money item receiving surface rearwardly of said longitudinal conveying direction.

The height of the second capture region may be less than 1.2 mm for example 1.0 mm or less, and the height of the first capture region is at least in part greater than that of the first capture region.

A plurality of said conveyor members may pivotally connected and provided with a respective set of said first and second lugs, and the conveyor may be configured in a continuous loop comprising an elevating section extending from the money item receiving section to the processing section, and a descending section extending back to the receiving section, the first and second capture regions being configured to hold a single one of the money items during passage of the conveyor along the elevating section. Also, the first and second lugs may include respective support surfaces facing rearwardly in said conveying direction for supporting a money item that remains on the conveyor after passage through the processing station during conveyance along the descending section.

A toothed track may be recessed in the or each said conveyor member, and a motor driven gear may be provided to engage with the track to drive the conveyor.

Also described herein is a conveyor to receive and convey money items having a generally discoidal surface and a peripheral edge, comprising a conveyor member having a money item receiving surface, and first and second lugs upstanding from said surface each having forward facing capture regions configured to be driven in a longitudinal conveying direction through a money item receiving station to receive a money item with its major discoidal surface overlying the surface and with its peripheral edge abutting the capture regions of the lugs, one of the capture regions of the lugs being upstanding from said money item receiving surface at least in part by a height greater than the other capture region, and the capture regions are so arranged that if first and second of said money items become lodged on the money item receiving surface and abutting the first and second capture regions respectively, upon forward movement of the conveyor in the longitudinal conveying direction, the first money item is urged by the first capture region against the second money item so as to dislodge the second money item from abutment with the second capture region so that solely the first money item is held in abutment with the first and second capture regions.

As used herein, the term "money item" includes coins which are issued by or on behalf of Governmental organisations that have generally disc shaped major surfaces, including coins in the US$ coin set, Euro coin set, GB pound coin set and the like. The coins may be circular or other discoidal shapes such as the hexagonal shape of a GB 50 pence piece and may include holes such as a central hole found in some coins. Also the term includes other disc shaped items with an attributable monetary value, such as tokens used in casinos.

BRIEF DESCRIPTION OF THE DRAWINGS

For the purposes of example only, embodiments are described below with reference to the accompanying figures, in which.

DETAILED DESCRIPTION

Figure 1:
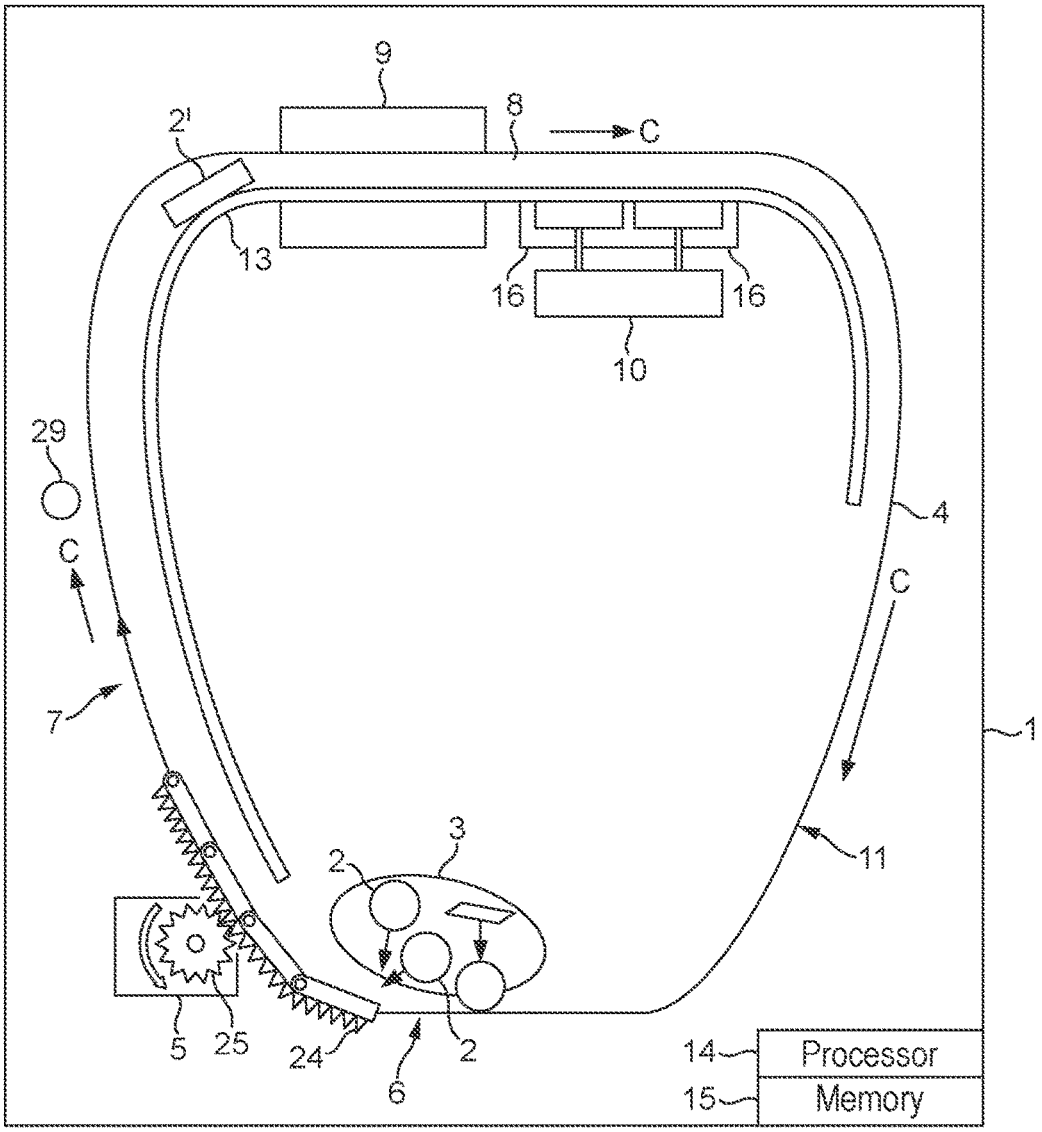
FIG. 1 is schematic diagram illustrating features of a money handling device.

Referring to FIG. 1, a money item handling device is shown, which in this example is operable to store and pay out coins of different denominations e.g. to provide change for a monetary transaction.

The device comprises a housing 1 which receives coins 2 of predetermined different denominations through an inlet 3, for example from coin acceptor devices which validate coins presented by a user during a vending transaction.

A continuous loop conveyor 4 is driven by a motor 5 to transport the coins 2 through the device for processing at one or more processing stations. The coins 2 are received on the conveyor at a receiving station 6 and tend to adopt a non-uniform, random stacked configuration at various angles in the station 6 where they fall onto the conveyor 4. As explained in more detail hereinafter, the conveyor is configured to transport the coins one by one i.e. in a singulated fashion along an elevating section 7 of the conveyor to a generally horizontal bridging section 8 which includes a processing station that includes coin sensor 9 and payout gates 10. Some coins may remain on the conveyor 4 after the payout gates 10 which pass along a descending section ii back to the receiving section 6.

As the conveyor 4 turns from the elevating section 7 to the bridging section 8, coins on the conveyor such as coin 2', are transferred and moved along a support surface 13 by the conveyor 4 through the coin sensor 9. The coin sensor 9 may be an inductive sensor including coils (not shown) and/or optical sensors on one or both sides of the conveyor 4 to detect inductive and/or optical characteristics of the coin, which may be compared by a processor 14 with reference values held in a memory 15 to determine their authenticity and denomination.

The payout gates 10 may comprise solenoid operated gates controlled by the processor 14, which can be selectively lowered so that selected coins moving along the surface 13 that have been detected by the sensor 9 to be of a particular denomination can be discharged into one or more outlet chutes 16 to be returned to the user, for example as change for the transaction.

Figure 2:
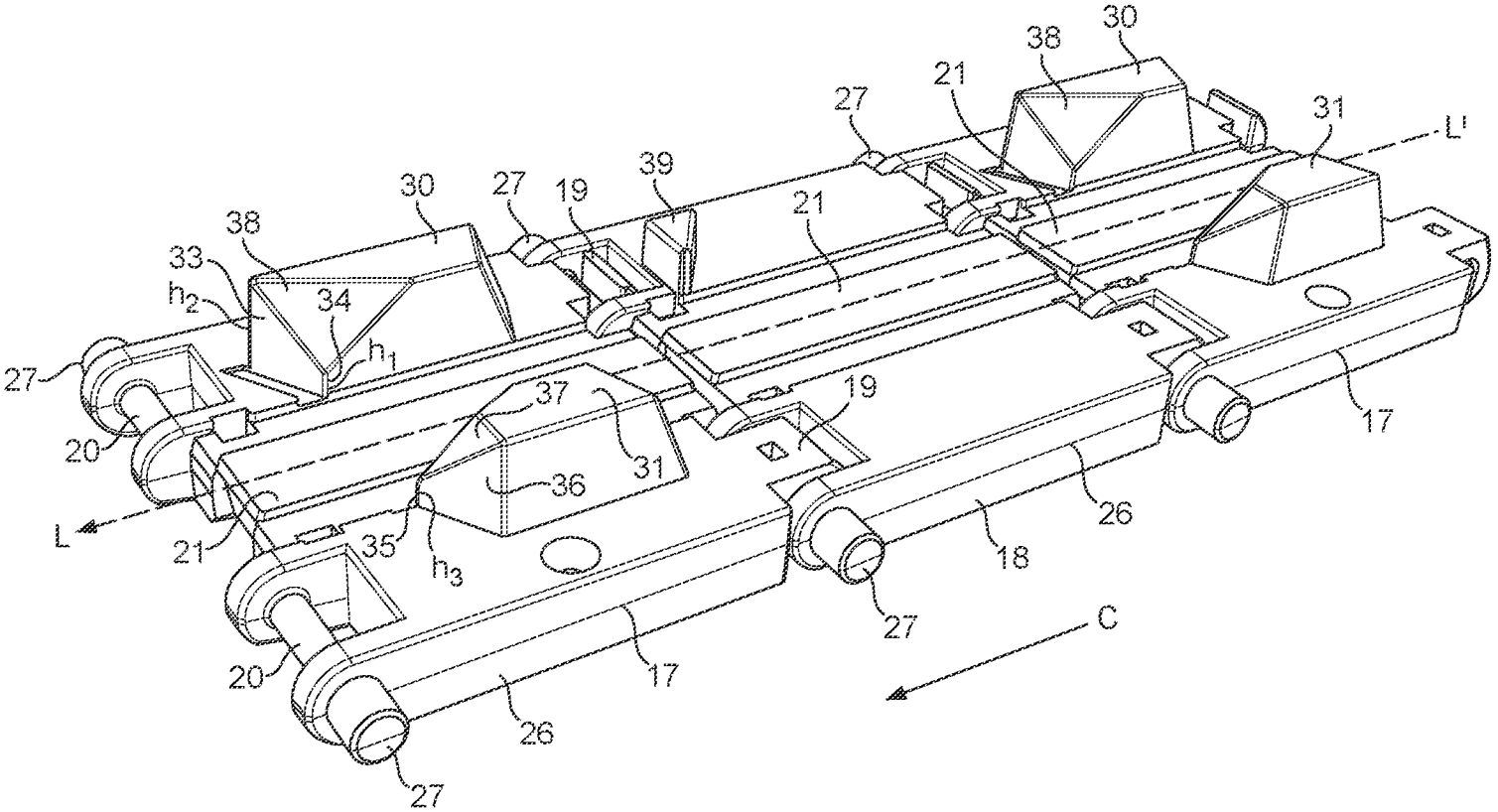
FIG. 2 is a perspective view from above of links of a conveyor for use in the money handling device of FIG. 1.
Figure 3:
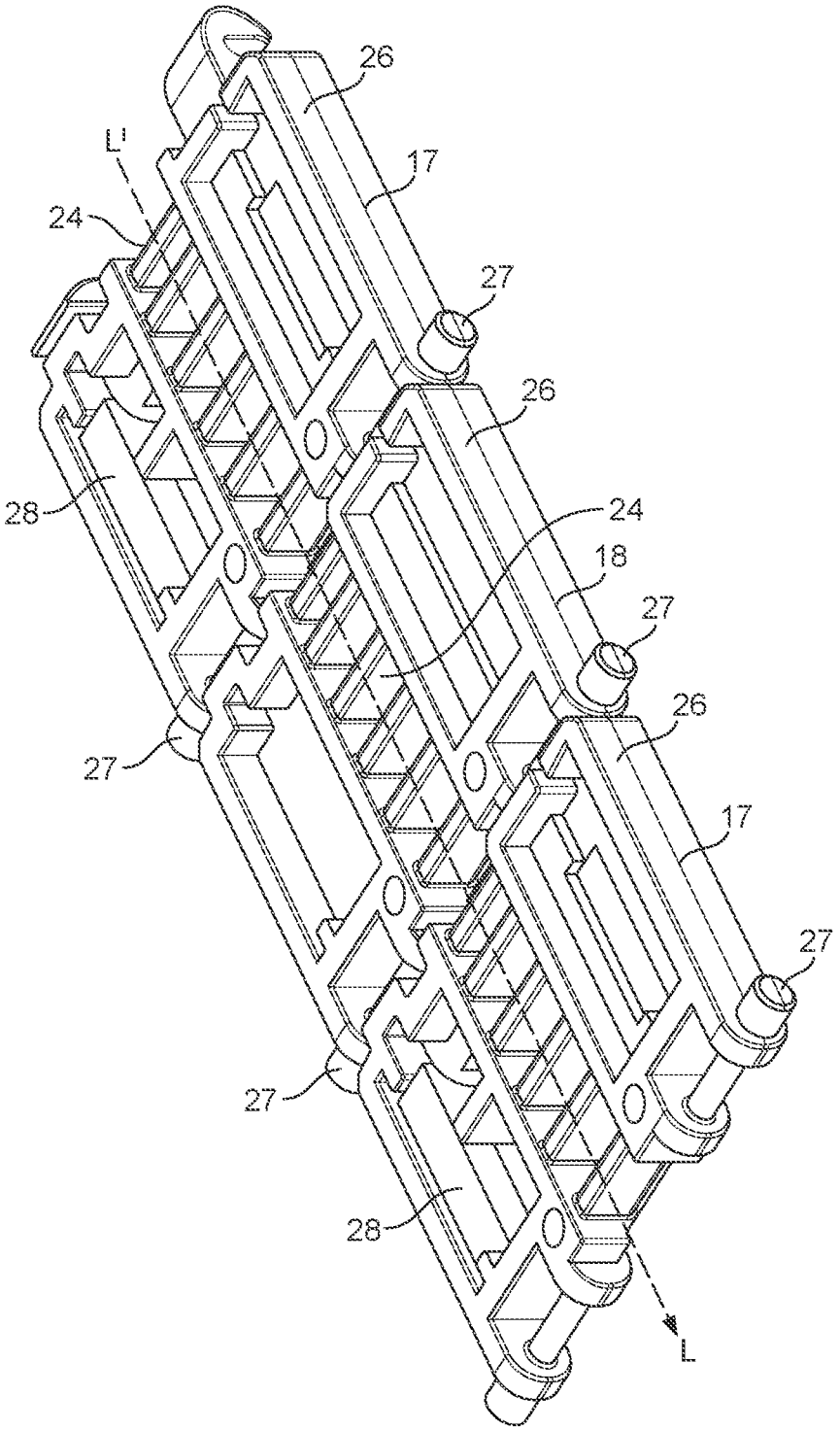
FIG. 3 is a perspective view from below of the links of the conveyor shown FIG. 2.

The conveyor 4 is made up of links illustrated in more detail in FIGS. 2 and 3, and comprises an alternating pattern of first and second link members 17, 18 that are pivotly connected to one another by grips 19 that engage shafts 20. The link members 17, 18 each include a generally planar money item receiving surface 21 which, in this example, receives coins, with the major discoidal surface of the coin 2 overlying the surface 21, as illustrated schematically in FIG. 4, with two coins of different diameters 2" and 2''' having respective major discoidal surfaces 22, 22' bounded by respective peripheries 23, 23'.

The link members 17, 18 have a longitudinal central axis L-L' and the conveyor is configured to move in a longitudinal conveyance direction C as shown in FIG. 2, along which the longitudinal axes of the link members 17, 18 are arranged.

Referring to FIG. 3, the link members 17, 18 are formed with a recessed driveable element, such as an integrally moulded toothed track 24 which, as shown in FIG. 1 engages with gear 25 driven by motor 5 so as to move the conveyor in the longitudinal conveying direction C. As shown in FIG. 3, the toothed track is recessed into the link members 17, 18. Also, each of the link members has protruding guide stubs 27 that extend transversely to the longitudinal conveying direction C to be received in a guide slot (not shown) extending around the path of the looped conveyor to guide the links around the path.

Also, as shown in FIG. 3, the links 17, 18 may include one or more recessed position locating elements for determining the position of the links 17, 18 with respect to a path of the track. The position locating elements mark the positions of each link 17, 18 and may comprise a recessed optical element, such as a light guide or light reflector. In the description below, the position locating elements are discussed in the context of reflective panels 28 which are recessed into the body of the links 17, 18 and may be detected by an optical detector 29 illustrated in FIG. 1, so as to count the link members 17 as they are conveyed around the conveyor loop.

Referring to FIG. 2, the first link members 17 include first and second lugs 30, 31 which are upstanding from the money item receiving surface 21 and are disposed on opposite sides of the longitudinal axis L-L'. The first and second lugs 30, 31 are configured to guide coins from the non-uniform stack that occurs in the receiving section 6 shown in FIG. 1 into the location on the conveyor 4 shown in FIG. 4, with a single coin captured between the lugs 30, 31, overlying the money item receiving surface 21.

As shown clearly in FIG. 2, the first lug 30 has a forward facing capture region 33 in the form of trapezoidal surface which forms an angle θ with longitudinal axis L-L' in the conveying direction C, with a height that increases outwardly from the longitudinal axis. The surface 33 forms a capture edge 34 with the main body of the lug 30 of a height $h_1$ which is not more than the minimum thickness of the various, predetermined acceptable denominations of coins that enter the receiving section 6 of FIG. 1. For example, the height of the capture edge 34 may be less than 1.2 mm, typically 1.0 mm.

The maximum height $h_2$ of the trapezoidal surface 33 is typical three or four times greater than the minimum height $h_1$ so as to engage with coins in the non-uniform stack of the receiving section 6 and encourage one of them to lie flat on the money item receiving section 21 between the lugs 30, 31 as the conveyor 4 passes through the receiving section 6 in the longitudinal conveying direction C.

The second lug 31 has a coin capture region in the form of an upstanding coin edge 35 at the join of first and second guide surfaces 36, 37 that are upstanding from the money item receiving surface 21 and diverge rearwardly with respect to the longitudinal conveying direction C. The capture edge 35 of lug 31 is of a height edge $h_3$ which is less than the minimum thickness of the coins 2 received in the receiving section 6 and may for example be equal to the height $h_1$ of the first lug 30. For example, the height of the capture edge 35 may be less than 1.2 mm, typically 1.0 mm.

Thus, when each of the first link members 17 passes through the coin receiving section 6 shown in FIG. 1 the coin capture regions 33, 35 co-operate to capture a single coin from the non-uniform stack of coins in the receiving section 6 such that the captured coin becomes located between the capture edges 34, 35, overlying the money item receiving surface 21.

Figure 5:
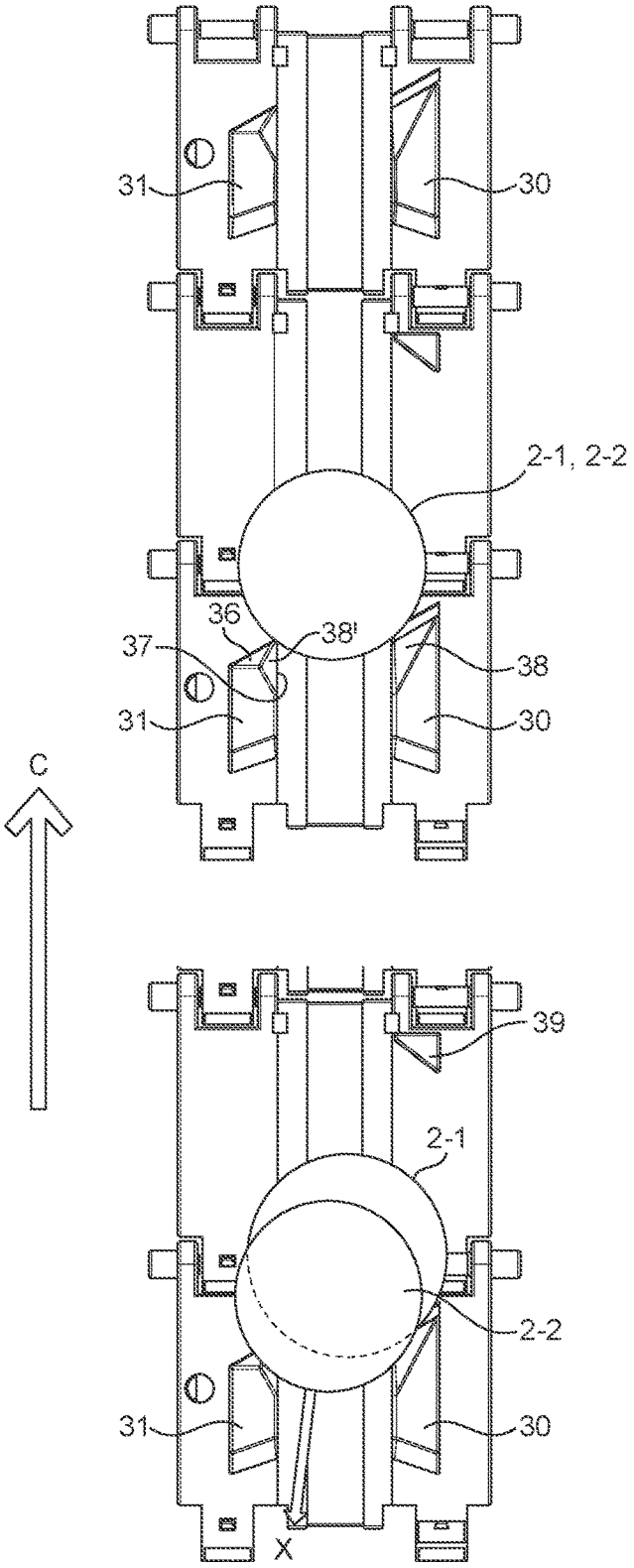
FIG. 5 illustrates how a stack of coins received on the conveyor are singulated i.e. separated so that only one coin is received and conveyed by the link.
Figure 6:
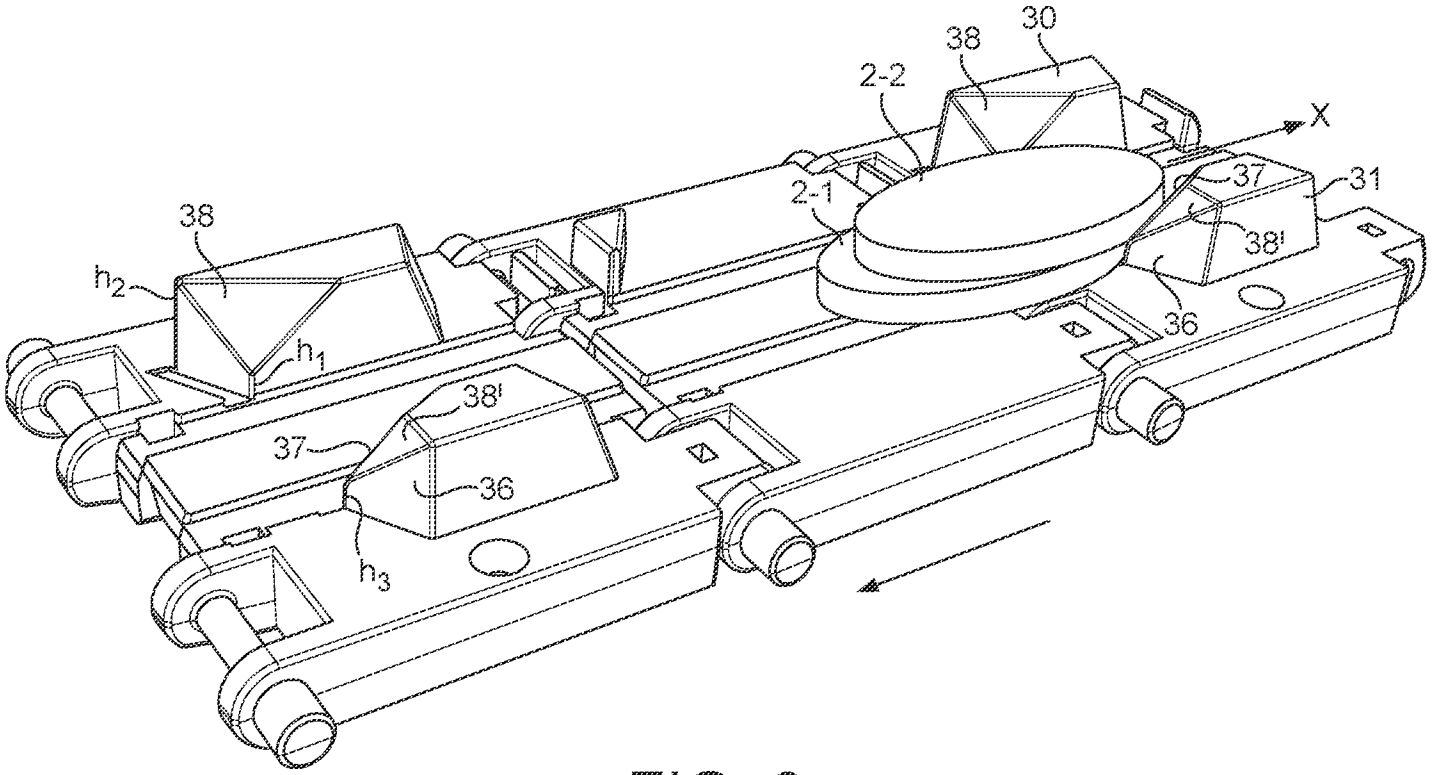
FIG. 6 is a perspective view of the singulation process shown in FIG. 5.

The lugs 30, 31 are configured to capture only one coin 2 from the stack as will now be explained with reference to FIGS. 5 and 6. As shown in FIG. 6, the lugs 30, 31 include scoop surfaces comprising a generally triangular, chined surface 38 on the first lug 30 together with a chined, scoop surface 38' on the second lug 31, so that, as shown in FIG. 6, when two coins 2-1, 2-2 become lodged in a stack during the coin capture process at the receiving station 6, the forward movement of the conveyor in direction C causes the uppermost coin 2-2 in the stack to slide over the scoop surfaces 38, 38' in the direction of arrow X so that only the lowermost coin 2-1 is retained between the coin capture edges 34, 35.

Figure 4:
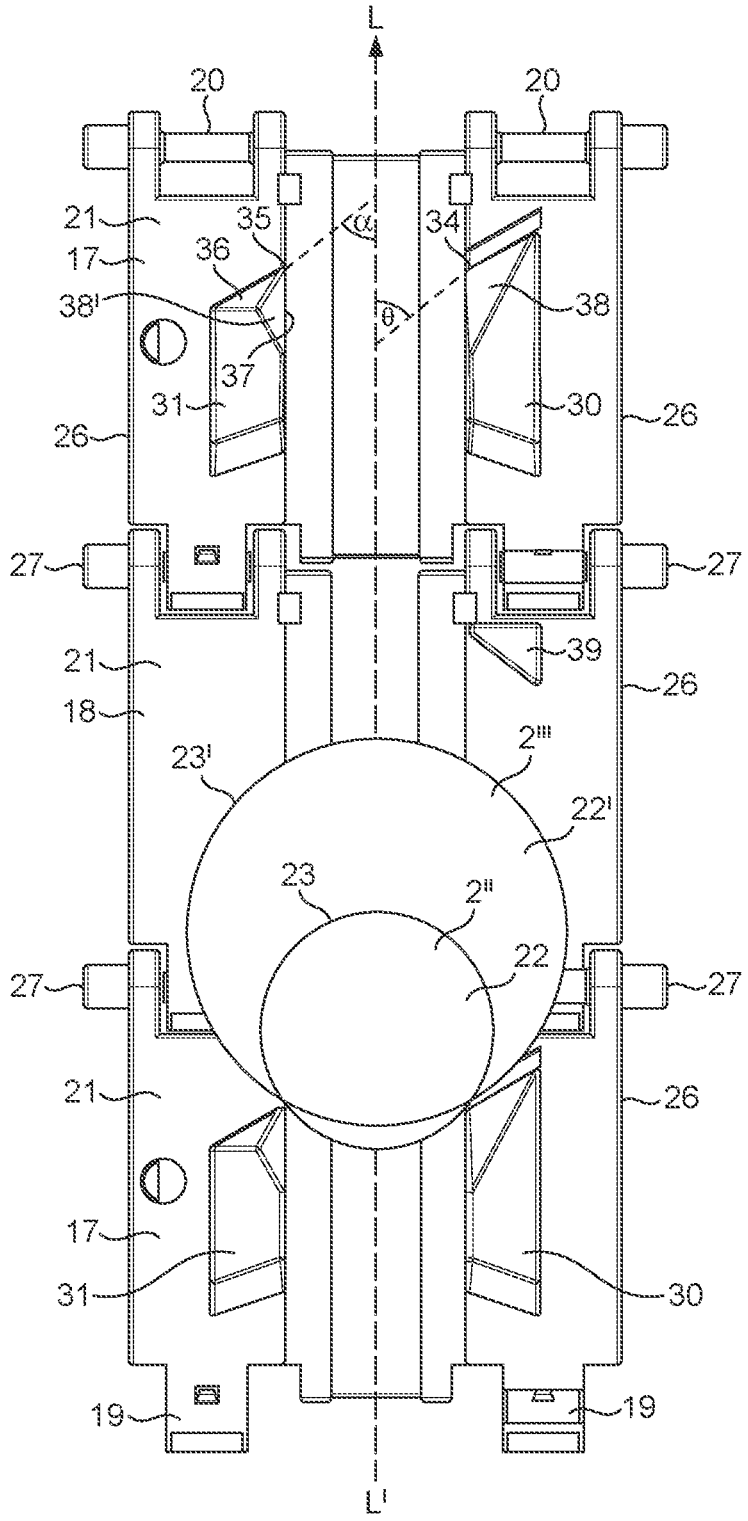
FIG. 4 is a schematic illustration of how coins of different diameters and thicknesses can be received on the conveyor.
Figure 7:
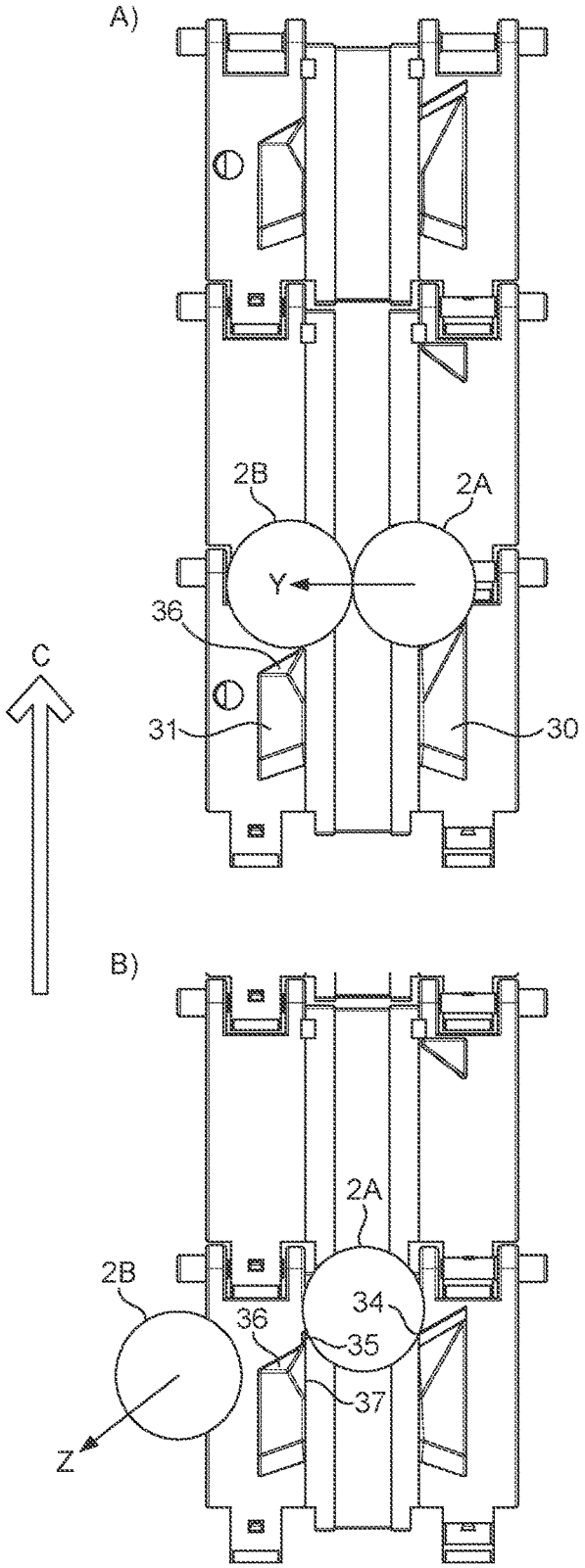
FIG. 7 illustrates a singulation process for two coins side by side on the conveyor.

Referring to FIG. 7, the first and second lugs 30, 31 are also configured to prevent two smaller coins becoming lodged side by side on the money item receiving surface 21 as the link members 17,18 pass through the coin receiving section 6. As shown in FIG. 7A, two coins 2*a*, 2*b* have become lodged against the first and second lugs 30, 31 during the coin capture process in the coin receiving section 6. Considering the coin 2*a*, it has been captured against the upstanding surface 34, which is inclined at angle θ to the longitudinal axis L-L' as shown in FIG. 4, so that as the conveyor moves forward in direction C, the coin 2A shown in FIG. 7A is urged against the coin 2B in the direction of arrow Y by a transverse reaction force produced by engagement with the lug 30, which urges the coin 2B out of engagement with the capture edge 35 of the second lug 31. As shown in FIG. 4, the surface 36 of the second lug 31 is inclined at angle α to the longitudinal axis L-L' so that, as shown in FIG. 7B, the coin 2B then moves along the surface 36 in the direction of arrow Z and the coin 2A then moves into a position captured between the capture edges 34, 35 of the first and second lugs 30, 31.

Also, as shown clearly in FIG. 2, each second link member 18 includes an upstanding lug 39 which is located to prevent two large coins such as two of the coin denomination 2''' shown in FIG. 4 becoming jammed between the successive pairs of lugs 30, 31 shown in FIG. 4.

Figure 8:
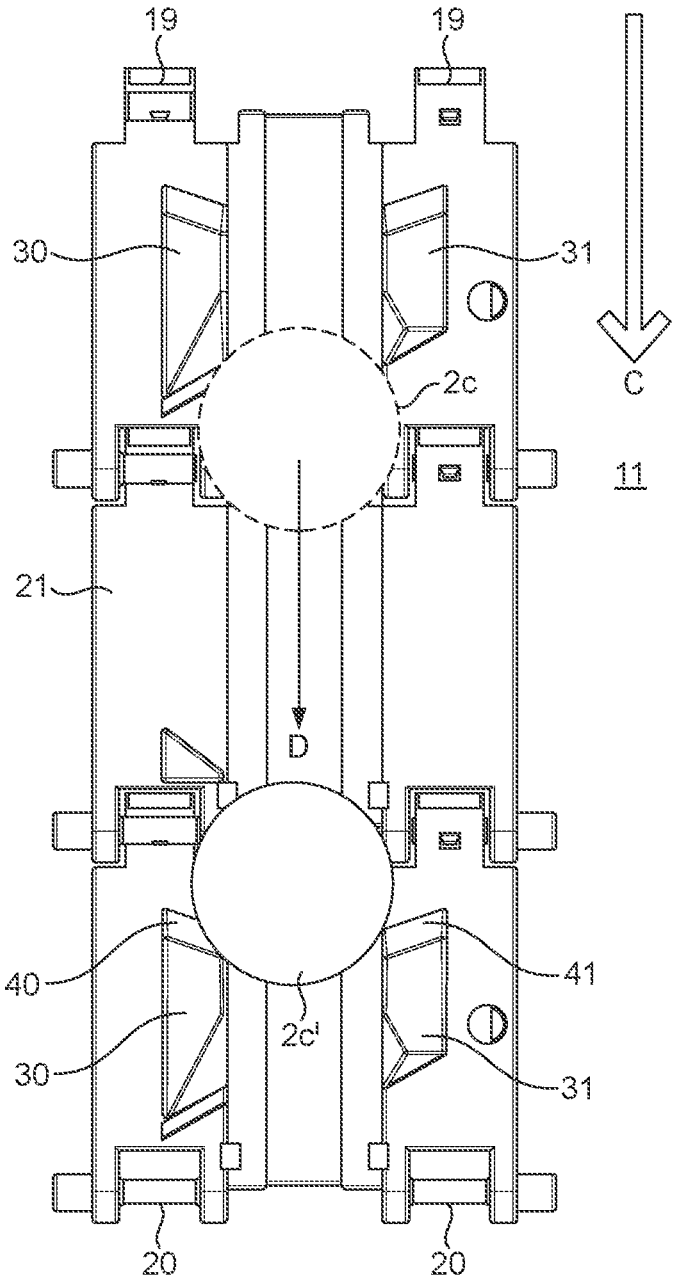
FIG. 8 shows capture of a coin on a downward descent of the conveyor.

Referring to FIG. 8, the first and second lugs 30, 31 also include inwardly inclined, upstanding support surfaces 40, 41 that are facing rearwardly of the longitudinal conveying direction C, on opposite sides of the longinitudianl axis L-L' so that when a coin captured between the capture edges 34, 35 of first and second lugs 30, 31, after being slid over the horizontal surface of the bridging region 13 and entering the descending section 11, the coin 2C falls and slides over the surface 21 to abut the inclined surfaces 40, 41, so as to be retained on the conveyor during its descend through the descending section ii shown in FIG. 1.

Many modifications and variations of the described device are possible. For example, the coin handling device may be used not only for vending but also in casinos and other situations where coins or money item items such as tokens need to be processed. Moreover, the disclosure of the present application should be understood to include any novel features or any novel combination of features either explicitly or implicitly disclosed herein or in any generalisation thereof and during prosecution of the present application or of any application derived therefrom, new claims may be formulated to cover any such features and/or combination of such features. Many other variations will be evident to those skilled in the art falling within the scope of the claims hereinafter.

The invention claimed is:

1. A handling device for money items having a generally discoidal surface and a peripheral edge, the handling device comprising:

a receiving station configured to receive money items supplied thereto, a money item processing station; and a conveyor configured to convey money items from the money item receiving station to the money item processing station, the conveyor comprising:

a conveyor member having a money item receiving surface, and first and second lugs upstanding from said money item receiving surface, the first lug comprising a forward facing first capture region and the second lug comprising a forward facing second capture region, the capture regions configured to be driven in a longitudinal conveying direction through the money item receiving station to receive a money item with its major discoidal surface overlying the money item receiving surface and with its peripheral edge abutting the capture regions of the lugs, one of the capture regions of the lugs being upstanding from said money item receiving surface at least in part by a height greater than the other capture region, wherein the capture regions are arranged such that if first and second of said money items become lodged on the money item receiving surface and abutting the first and second capture regions respectively, upon forward movement of the conveyor in the longitudinal conveying direction, the first money item is urged by the first capture region against the second money item so as to dislodge the second money item from abutment with the second capture region so that solely the first money item is held in abutment with the first and second capture regions, wherein the first and second lugs are disposed on opposite sides of a longitudinal axis of the conveyor member, and the first capture region of the first lug comprises a capture surface facing forwardly in said longitudinal conveying direction, having a height which reduces in a direction of said longitudinal axis, and wherein the capture surface is trapezoidal and forms an acute angle with the longitudinal axis in the longitudinal conveying direction and with a height that increases outwardly from the longitudinal axis.

2. The handling device as claimed in claim 1, wherein the receiving station is configured to receive a plurality of money items of different dimensions that comprise opposed, spaced apart, generally discoidal major surfaces with a thickness dimension between the major surfaces falling within a predetermined thickness range having a minimum thickness value, wherein a maximum height by which the capture regions of first and second lugs are each upstanding from the money item receiving surface is more than said minimum thickness value and less than said minimum thickness value respectively.

3. The handling device as claimed in claim 1, wherein the second capture region comprises an upstanding capture edge at a join of a first guide surface and a second guide surface that are upstanding from the money item receiving surface and diverge rearwardly with respect to said longitudinal conveying direction.

4. The handling device as claimed in claim 1, comprising at least one scoop surface on at least one of the first and second lugs, so arranged that if first and second of said money items become arranged in a stack in engagement with the capture region of the first lug, an upper one of the money items is guided by the at least one scoop surface to pass by the lugs upon forward movement of the conveyor in said longitudinal conveying direction such that solely a lowermost money item in the stack abuts the first and second capture regions.

5. The handling device as claimed in claim 4, wherein the at least one scoop surface diverges from the money item receiving surface rearwardly of said longitudinal conveying direction.

6. The handling device as claimed in claim 1, wherein the height of the second capture region is less than 1.2 mm and the height of the first capture region is at least in part greater than that of the second capture region.

7. The handling device as claimed in claim 1, wherein the height of the second capture region is less than 1.0 mm and the height of the first capture region is at least in part greater than that of the second capture region.

8. The handling device as claimed in claim 1, further comprising a plurality of said conveyor members pivotally connected and provided with a respective set of said first and second lugs.

9. The handling device as claimed in claim 1, wherein the conveyor is configured in a continuous loop comprising an elevating section extending from the money item receiving section to a processing section, and a descending section extending back to a receiving section, the first and second capture regions being configured to hold a single one of the money items during passage of the conveyor along the elevating section.

10. The handling device as claimed in claim 9, wherein the first and second lugs include respective support surfaces facing rearwardly in said longitudinal conveying direction for supporting a money item that remains on the conveyor after passage through the money item processing station during conveyance along the descending section.

11. The handling device as claimed in claim 1, including a driveable element recessed in said conveyor member, and a motor driven gear engaging with a track to drive the conveyor.

12. The handling device as claimed in claim 11, wherein the driveable element comprises a toothed track recessed in said conveyor member.

13. A conveyor to receive and convey money items having a generally discoidal surface and a peripheral edge, comprising a conveyor member including:

a money item receiving surface; and first and second lugs upstanding from said money item receiving surface, the first lug comprising a forward facing first capture region and the second lug comprising a forward facing second capture region, the capture regions configured to be driven in a longitudinal conveying direction through a money item receiving station to receive a money item with its major discoidal surface overlying the money item receiving surface and with its peripheral edge abutting the capture regions of the lugs, one of the capture regions of the lugs being upstanding from said money item receiving surface at least in part by a height greater than the other capture region, and the capture regions being so arranged that if first and second of said money items become lodged on the money item receiving surface and abutting the first and second capture regions respectively, upon forward movement of the conveyor in the longitudinal conveying direction, the first money item is urged by the first capture region against the second money item so as to dislodge the second money item from abutment with the second capture region so that solely the first money item is held in abutment with the first and second capture regions, wherein the first and second lugs are disposed on opposite sides of a longitudinal axis of the conveyor member, and the first capture region of the first lug comprises a capture surface facing forwardly in said longitudinal conveying direction, having a height which reduces in the direction of said longitudinal axis, and wherein the capture surface is trapezoidal and forms an acute angle with the longitudinal axis of the conveying member in the longitudinal conveying direction and with a height that increases outwardly from the longitudinal axis.

14. The conveyor as claimed in claim 13, wherein the second capture region comprises an upstanding capture edge at a join of first and second guide surfaces that are upstanding from the money item receiving surface and diverge rearwardly in said longitudinal conveying direction.

15. The conveyor as claimed in claim 13, including at least one scoop surface on each of the first and second lugs so arranged that if first and second of said money items become arranged in a stack in engagement with the capture region of the first lug, an upper one of the money items is guided by each said scoop surface to pass by the lugs upon forward movement of the conveyor in said longitudinal conveying direction such that solely a lowermost money item in the stack abuts the first and second capture regions.

16. The conveyor as claimed in claim 15, wherein the scoop surfaces diverge from the money item receiving surface rearwardly of said longitudinal conveying direction.

* * * * *